US008752452B2

(12) United States Patent
Hsu

(10) Patent No.: US 8,752,452 B2
(45) Date of Patent: Jun. 17, 2014

(54) INERTIAL FLYWHEEL

(76) Inventor: Wen-Pin Hsu, Taichung (TW)

( * ) Notice: Subject to any disclaimer, the term of this patent is extended or adjusted under 35 U.S.C. 154(b) by 50 days.

(21) Appl. No.: 13/610,249

(22) Filed: Sep. 11, 2012

(65) Prior Publication Data

US 2013/0239742 A1 Sep. 19, 2013

(30) Foreign Application Priority Data

Mar. 14, 2012 (TW) ..... 101204589 U

(51) Int. Cl.
*F16C 15/00* (2006.01)

(52) U.S. Cl.
USPC ..... 74/572.2

(58) Field of Classification Search
USPC ..... 74/572.2, 572.21, 573.1, 573.13, 574.2, 74/574.3, 574.4; 482/50, 110; 280/217
IPC ..... F16C 15/00; F16F 15/00,15/24
See application file for complete search history.

(56) References Cited

U.S. PATENT DOCUMENTS

| | | | | |
|---|---|---|---|---|
| 2,474,370 | A * | 6/1949 | Russell | 74/571.11 |
| 4,817,453 | A * | 4/1989 | Breslich et al. | 74/572.4 |
| 4,977,794 | A | 12/1990 | Metcalf | |
| 5,191,809 | A | 3/1993 | Craig | |
| 5,197,352 | A * | 3/1993 | Haikawa | 123/192.2 |
| 2008/0083298 | A1 * | 4/2008 | Lin | 74/572.2 |
| 2009/0173183 | A1 * | 7/2009 | Chen | 74/572.21 |

* cited by examiner

*Primary Examiner* — Thomas R Hannon
*Assistant Examiner* — Adam D Rogers
(74) *Attorney, Agent, or Firm* — Pepper Hamilton LLP

(57) ABSTRACT

An inertial flywheel includes a wheel body defining an axis of rotation and including a first sidewall, a second sidewall axially spaced apart from the first sidewall, a peripheral wall surrounding the axis of rotation and interconnecting the first and second sidewalls, and a plurality of circumferentially spaced-apart mounting seats connected to the first sidewall. The first and second sidewalls and the peripheral wall cooperatively define a chamber dispersed with a cementing material. Each of the mounting seats has a counterweight-receiving groove adapted for insertion with one of counterweights of a counterweight unit.

7 Claims, 3 Drawing Sheets

INERTIAL FLYWHEEL

CROSS-REFERENCE TO RELATED APPLICATION

This application claims priority of Taiwanese Application No. 101204589, filed on Mar. 14, 2012, the disclosure of which is incorporated herein by reference.

BACKGROUND OF THE INVENTION

1. Field of the Invention

The invention relates to an inertial flywheel, and more particularly to an inertial flywheel for an exercise apparatus.

2. Description of the Related Art

A conventional exercise apparatus usually uses a flywheel made from a cast metal for resistance control in operation.

To reduce the fabrication cost of using a metal material, U.S. Pat. Nos. 4,977,794 and 5,191,809 disclose a conventional inertial flywheel having a hollow body filled with hematite chips, magnetite powder, hydrated lime, portland cement, and water. However, the conventional inertial flywheels may have a problem with departure of a gravity center from a central axis, and their gravity center is not adjustable. When rotating, the conventional inertial flywheels having the eccentric and non-adjustable gravity center tend to vibrate, swerve and provide uneven resistance.

SUMMARY OF THE INVENTION

Therefore, an object of this invention is to provide an inertial flywheel for an exercise apparatus that can alleviate the aforesaid drawbacks of the prior art.

According to the present invention, an inertial flywheel for an exercise apparatus includes a wheel body, a cementing material and a counterweight unit.

The wheel body defines an axis of rotation and includes a first sidewall, a second sidewall axially spaced apart from the first sidewall, a peripheral wall surrounding the axis of rotation and interconnecting the first and second sidewalls, and a plurality of circumferentially spaced-apart mounting seats connected to the first sidewall. The first and second sidewalls and the peripheral wall cooperatively define a chamber. Each of the mounting seats has a counterweight-receiving groove that opens through the first sidewall.

The cementing material is dispersed in the chamber.

The counterweight unit optionally is inserted into at least one of the counterweight-receiving grooves.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE PREFERRED EMBODIMENT

Figure 1:
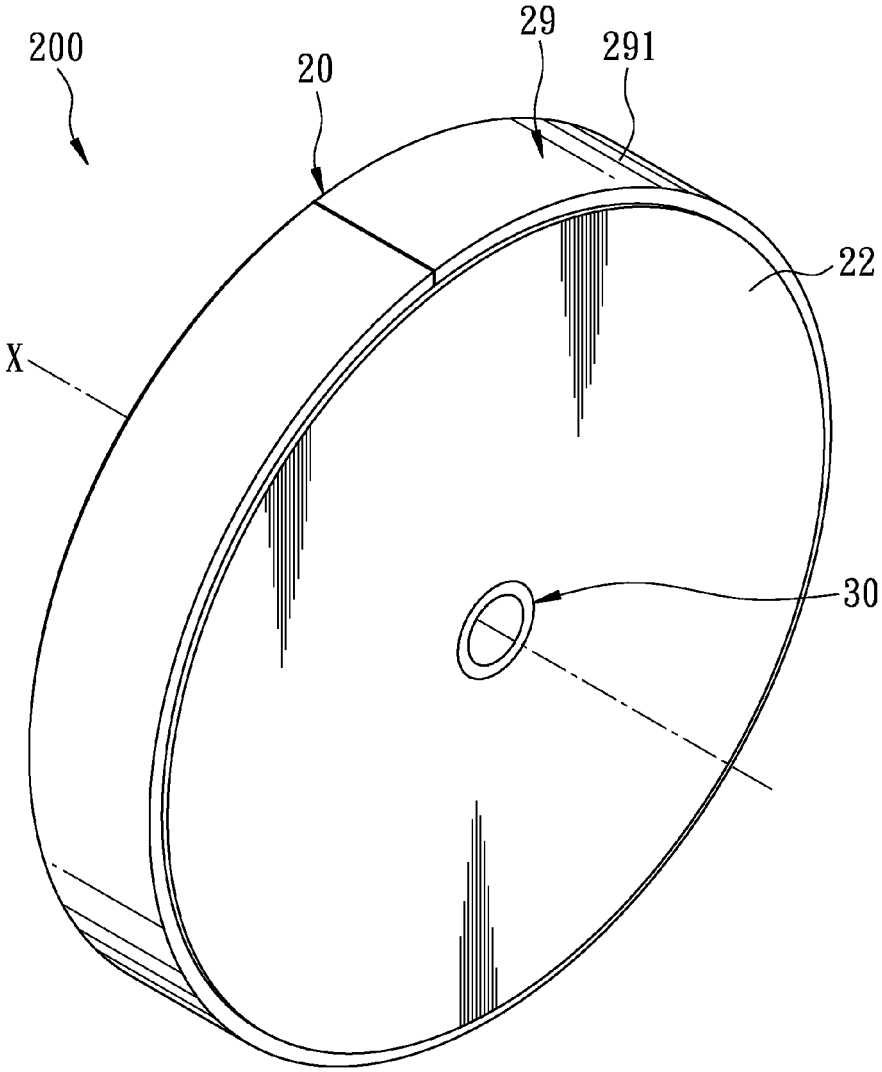
FIG. 1 is a perspective view of the preferred embodiment of an inertial flywheel for an exercise apparatus according to the present invention.
Figure 2:
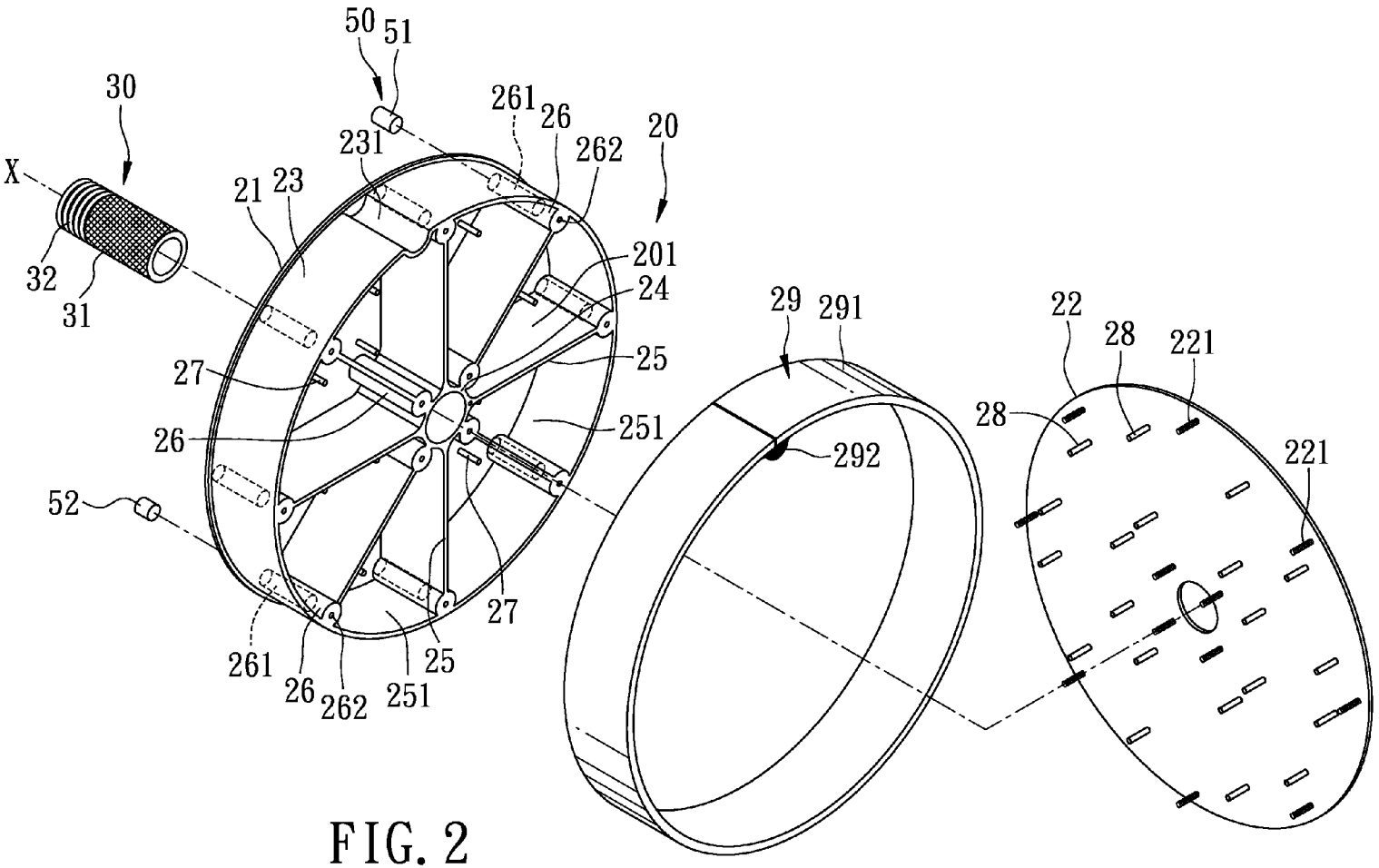
FIG. 2 is an exploded perspective view of the preferred embodiment of FIG. 1 illustrating the configuration structure of each of a wheel body, a shaft, and a counterweight unit.
Figure 3:
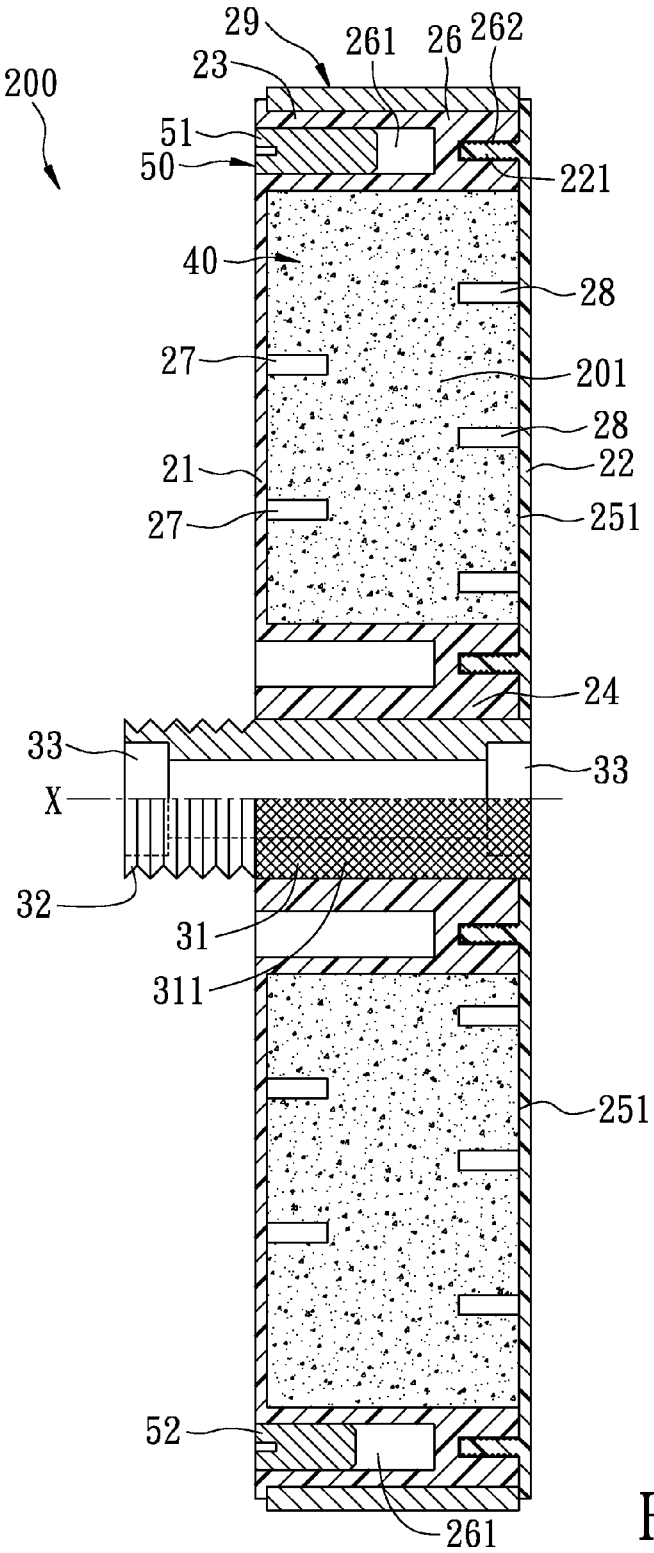
FIG. 3 is a sectional view of the preferred embodiment of FIG. 1 illustrating a connection structure among the wheel body, the shaft, a cementing material and the counterweight unit.

Referring to FIGS. 1 to 3, an inertial flywheel 200 for an exercising apparatus according to the preferred embodiment of the present invention includes a wheel body 20, a metal ring 29, a shaft 30, a cementing material 40, and a counterweight unit 50.

The wheel body 20 defines an axis (X) of rotation and includes a first sidewall 21, a second sidewall 22 axially spaced apart from the first sidewall 21, a peripheral wall 23 surrounding the axis (X) of rotation and interconnecting the first and second sidewalls 21, 22, and a plurality of circumferentially spaced-apart mounting seats 26 connected to the first sidewall 21. The first and second sidewalls 21, 22 and the peripheral wall 23 cooperatively define a chamber 201.

Preferably, the wheel body 20 further includes a hub 24 surrounding the axis (X) of rotation and surrounded by the peripheral wall 23, and a plurality of spokes 25 disposed in the chamber 201, extending from the peripheral wall 23 to the hub 24, and connected to the first sidewall 21. The spokes 25 divide the chamber 201 into a plurality of filling spaces 251, and the cementing material 40 is distributed in the filling spaces 251. In this preferred embodiment, there are eight spokes 25 and eight equal-volume filling spaces 251 divided thereby.

Preferably, each of the mounting seats 26 has a counterweight-receiving groove 261 that opens through the first sidewall 21, and has a pin-receiving groove 262 that opens toward the second sidewall 22. In this embodiment, the mounting seats 26 are evenly distributed around the axis (X) of rotation. Aside from the circumferentially spaced-apart mounting seats 26 connected to the first side wall 21, additional spaced-apart mounting seats 26 are formed on the hub 24. In this embodiment, each of the mounting seats 26 is configured as a tubular body that extends along a direction parallel to the axis (X) of rotation and that is formed integrally as one piece with the first sidewall 21. The counterweight-receiving groove 261 and the pin-receiving groove 262 are located at two opposite sides of a corresponding one of the mounting seats 26, respectively. Preferably, the second sidewall 22 has a plurality of pins 221 that are respectively inserted into the pin-receiving grooves 262.

The metal ring 29 is sleeved on an outer surface of the peripheral wall 23. The metal ring 29 includes an elongate metal plate 291 rolled into a circular shape, and a weld joint 292 interconnecting two opposite ends of the elongate metal plate 291 to form the metal ring 29. In this embodiment, the outer surface of the peripheral wall 23 is formed with a recess 231 that opens toward the metal ring 29. The weld joint 292 projects from an inner side of the metal ring 29 into the recess 231.

The shaft 30 includes an engaging section 31 engaged to the hub 24 and a drive section 32 that is opposite to the engaging section 31 and disposed externally of the wheel body 20. Each of the engaging section 31 and the drive section 32 has a bearing mounting part 33. Preferably, the engaging section 31 of the shaft 30 has a rough surface 311 engaged to the hub 24. When the first sidewall 21, the peripheral wall 23, and the hub 24 are integrally made with the shaft 30 using injection molding techniques, the shaft 30 is firstly formed and then the hub 24 and the rough surface 311 are formed into a firm engaging structure.

The drive section 32 of the shaft 30 may be connected to a drive belt used in a conventional exerciser (not shown).

The bearing mounting parts 33 of the engaging section 31 and the drive section 32 may be respectively mounted with two bearings (not shown).

Preferably, the wheel body 20 may further include a plurality of first anchor bolts 27 extending from the first sidewall 21 toward the second sidewall 22, and a plurality of second anchor bolts 28 extending from the second sidewall 22 toward the first sidewall 21.

The cementing material 40 is dispersed in the chamber 201 of the wheel body 20. In this embodiment, the cementing material 40 is concrete and is distributed in the filling spaces 251. In practical application, the cementing material 40 may be cement. The cementing material 40 is poured into the filling spaces 251 before the second sidewall 22 is connected to the peripheral wall 23. After the cementing material 40 is solidified, even if the volume of the cementing material 40 is reduced due to moisture evaporation, the cementing material 40 is firmly retained in the wheel body 20 by means of the arrangement of the first and second anchor bolts 27, 28.

The counterweight unit 50 may include a plurality of counterweights that are optionally and respectively inserted into the counterweight-receiving grooves 261. In this preferred embodiment, the counterweight unit 50 includes at least one first counterweight 51 and at least one second counterweight 52 which have different weights. In FIG. 2, one first counterweight 51 and one second counterweight 52 are shown. In practice, the counterweight unit 50 may include counterweights of various weight specifications so as to comply with the number of the counterweight-receiving grooves 261 and the intended adjustment of the center of gravity of the inertial flywheel 200.

By virtue of a structural design of the first and second counterweights 51, 52 distributed around the axis (X) of rotation, when the inertial flywheel 200 is tested before shipping, if the initial center of gravity formed by the cementing material 40 and the wheel body 20 departs from the axis (X) of rotation, a manufacturer may insert one of the first counterweights 51 and the second counterweights 52 into the appropriate counterweight-receiving grooves 261 based on the weight of the first and second counterweights 51, 52 and on the distance of the initial center of gravity from the axis (X) of rotation. Besides, the first and second counterweights 51, 52 may be combined to be distributed in the wheel body 20 for balancing weight, so that the center of gravity of the inertial flywheel 200 is proximate to the axis (X) of rotation and located at the center of the overall structure of the inertial flywheel 200, thereby achieving the intended object of adjusting the center of gravity of the inertial flywheel 200.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An inertial flywheel for an exercise apparatus, comprising:

a wheel body defining an axis of rotation and including a first sidewall, a second sidewall axially spaced apart from said first sidewall, a peripheral wall surrounding said axis of rotation and interconnecting said first sidewall and said second sidewall, and a plurality of circumferentially spaced-apart mounting seats connected to said first sidewall, said first sidewall and said second sidewall, and said peripheral wall cooperatively defining a chamber, each of said mounting seats having a counterweight-receiving groove that opens through said first sidewall;

a cementing material dispersed in said chamber;

a counterweight unit including at least one counterweight that is inserted into at least one of said counterweight-receiving grooves; and a metal ring sleeved on an outer surface of said peripheral wall, wherein said outer surface of said peripheral wall is formed with a recess that opens toward said metal ring, said metal ring including an elongate metal plate rolled into a circular shape, and a weld joint interconnecting two opposite ends of said elongate metal plate to form said metal ring, said weld joint projecting from an inner side of said metal ring into said recess.

2. The inertial flywheel as claimed in claim 1, wherein said wheel body further includes a hub surrounding said axis of rotation and surrounded by said peripheral wall, said inertial flywheel further comprising a shaft that includes an engaging section engaged to said hub and a drive section opposite to said engaging section and disposed externally of said wheel body, each of said engaging section and said drive section having a bearing mounting part.

3. The inertial flywheel as claimed in claim 2, wherein each of said mounting seats further has a pin-receiving groove that opens toward said second sidewall, said second sidewall having a plurality of pins respectively inserted into said pin-receiving grooves.

4. The inertial flywheel as claimed in claim 3, wherein each of said mounting seats is configured as a tubular body that extends along a direction parallel to said axis of rotation and that is formed integrally as one piece with said first sidewall, said counterweight-receiving groove and said pin-receiving groove being located at two opposite sides of a corresponding one of said mounting seats, respectively.

5. The inertial flywheel as claimed in claim 1, wherein said wheel body further includes a plurality of first anchor bolts extending from said first sidewall toward said second sidewall, and a plurality of second anchor bolts extending from said second sidewall toward said first sidewall.

6. The inertial flywheel as claimed in claim 1, wherein said counterweight unit includes at least one first counterweight and at least one second counterweight which have different weights.

7. An inertial flywheel for an exercise apparatus, comprising:

a wheel body defining an axis of rotation and including a first sidewall, a second sidewall axially spaced apart from said first sidewall, a peripheral wall surrounding said axis of rotation and interconnecting said first sidewall and said second sidewall, and a plurality of circumferentially spaced-apart mounting seats connected to said first sidewall, said first sidewall and said second sidewall, and said peripheral wall cooperatively defining a chamber, each of said mounting seats having a counterweight-receiving groove that opens through said first sidewall;

a cementing material dispersed in said chamber;

a counterweight unit including at least one counterweight that is inserted into at least one of said counterweight-receiving grooves;

a hub surrounding said axis of rotation and surrounded by said peripheral wall, said inertial flywheel further comprising a shaft that includes an engaging section engaged to said hub and a drive section opposite to said engaging section and disposed externally of said wheel body, each of said engaging section and said drive section having a bearing mounting part, wherein each of said mounting seats further has a pin-receiving groove that opens toward said second sidewall, said second sidewall having a plurality of pins respectively inserted into said pin-receiving grooves; and a plurality of spokes disposed in said chamber, extending from said peripheral wall to said hub, and connected to said first sidewall, said spokes dividing said chamber into a plurality of filling spaces, said cementing material being distributed in said filling spaces.

* * * * *